United States Patent [19]

Beach

[11] Patent Number: 4,725,098

[45] Date of Patent: Feb. 16, 1988

[54] EROSION RESISTANT CUTTING BIT WITH HARDFACING

[75] Inventor: Wayne H. Beach, Roaring Spring, Pa.

[73] Assignee: Kennametal Inc., Latrobe, Pa.

[21] Appl. No.: 944,263

[22] Filed: Dec. 19, 1986

[51] Int. Cl.[4] ..... E21B 10/46

[52] U.S. Cl. ..... 299/79; 175/410; 299/92

[58] Field of Search ..... 299/79, 86, 91, 92; 175/410; 37/142 R

[56] References Cited

U.S. PATENT DOCUMENTS

| | | | |
|---|---|---|---|
| 3,945,681 | 3/1976 | White | 299/86 |
| 4,484,783 | 11/1984 | Emmerich | 299/92 X |
| 4,561,698 | 12/1985 | Beebe | 299/92 X |

FOREIGN PATENT DOCUMENTS

| | | | |
|---|---|---|---|
| 2442146 | 3/1975 | Fed. Rep. of Germany . | |
| 2801675 | 7/1979 | Fed. Rep. of Germany | 175/410 |
| 3005684 | 8/1981 | Fed. Rep. of Germany . | |
| 2004315 | 3/1979 | United Kingdom | 299/86 |
| 2037223 | 7/1980 | United Kingdom . | |
| 623959 | 9/1978 | U.S.S.R. . | |
| 0899916 | 1/1982 | U.S.S.R. | 299/79 |
| 911024 | 7/1983 | U.S.S.R. . | |
| 1102936 | 7/1984 | U.S.S.R. | 299/79 |

*Primary Examiner*—Stephen J. Novosad
*Assistant Examiner*—David J. Bagnell
*Attorney, Agent, or Firm*—Thomas R. Trempus

[57] ABSTRACT

A rotary cutting bit for use in mining and excavating applications that incorporates an annular groove about a head portion of the bit immediately rearwardly of where a hard tip of the bit is seated. A hardfacing material is deposited in the groove in the form of an annular ring.

12 Claims, 3 Drawing Figures

EROSION RESISTANT CUTTING BIT WITH HARDFACING

BACKGROUND OF THE INVENTION

The present invention generally relates to mining and excavating tools and, more particularly, is concerned with a cutting bit incorporating erosion resistant structure rearwardly of its hard tip wherein this erosion resistant structure includes a hardfacing material deposited in a channel in the bit body axially rearwardly of the hard tip.

Many mining and excavating tools employ drums and the like on which are mounted a multiplicity of rotary cutting bits. In the course of operating these tools, the bits are forcibly engaged with coal and rock formations to reduce the same and thus are subjected to a high degree of stress and wear. Typically, each bit has a hard, wear resistant, pointed insert or tip, for example, being composed of tungsten carbide, which contacts the formation. However, the hard tip is commonly attached to and supported on a conical head of the bit, composed of a different material, such as carbon steel, which is relatively soft when compared to the hard tip. As the bit tip penetrates and reduces the formation, the portion of the bit head backing the hard tip is also brought into abrasive contact with the formation.

Many different embodiments of bits having this general construction appear in the prior art. Representative of the prior art are the bits disclosed in U.S. Pat. Nos. to Healey et al. (3,356,418), Hansen et al. (3,796,464), McKenry et al. (3,830,321), Elders (3,833,264) and 3,833,265), Kniff et al. (3,841,707 and 3,841,708), Stoltz et al. (4,149,753), Den Besten et al. (4,201,421 and 4,462,638), Wrulich et al. (4,247,150), Hahn (4,470,210) and Emmerich (4,484,783).

One major problem with this general bit construction is that, while the hard tip is enduring these extremely abrasive conditions, its softer backing structure, i.e., the bit head, is eroding away, being washed or eaten away over time by its contact with the formation. Once the bit head has eroded a certain degree, it will break off, taking the hard tip with it. Thus, the useful life of the hard tip of each bit on the drum is dependent on how long the head of the bit can last before breaking off. Although there are a large number of bits on the drum, the number of broken off heads will soon increase to the point where replacement is required. Early replacement increases operating costs due to increased tool downtime and usage of replacement parts and maintenance labor.

Consequently, a need still exists for improvements in bit construction which will extend the life of the bit and thereby reduce operating costs without introducing other new costs in place thereof.

SUMMARY OF THE INVENTION

The present invention provides a cutting bit which incorporates erosion resistant tip backing structure designed to satisfy the aforementioned needs. In a specific embodiment, an annular groove is formed about the bit head portion immediately rearwardly of a seat defined on the forward end thereof within which is disposed the hard tip. A hardfacing material is deposited in the annular groove wherein it forms an annular ring.

Accordingly, the present invention is directed to a cutting bit for use in mining and excavating applications wherein the bit includes: a body having a rearward shank portion and a forward head portion; a wear resistant tip attached to a forward end of the head portion; and an annular ring of hardfacing attached about the head portion adjacent to and rearwardly of the tip attached thereon. The hardfacing is composed of a material harder than that of the head portion. More particularly, the head portion has a groove defined therein adjacent to and rearwardly of the forward end of the head portion, with the hardfacing being deposited in the groove. The ring of hardfacing fills the groove and may project therefrom outwardly beyond an exterior surface of the head portion. The groove extends circumferentially about the head portion and can have a concave arcuate configuration.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF SPECIFIC EMBODIMENTS

Figure 1:
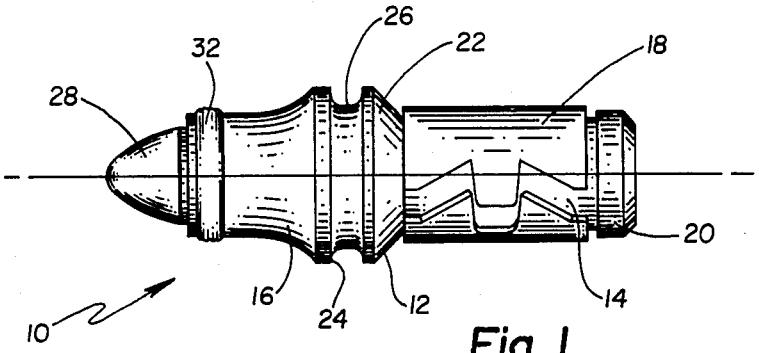
FIG. 1 is a side elevational view of a specific embodiment of a rotary cutting bit incorporating erosion resistant structure in accordance with the present invention in the form of an annular ring of hardfacing.
Figure 2:
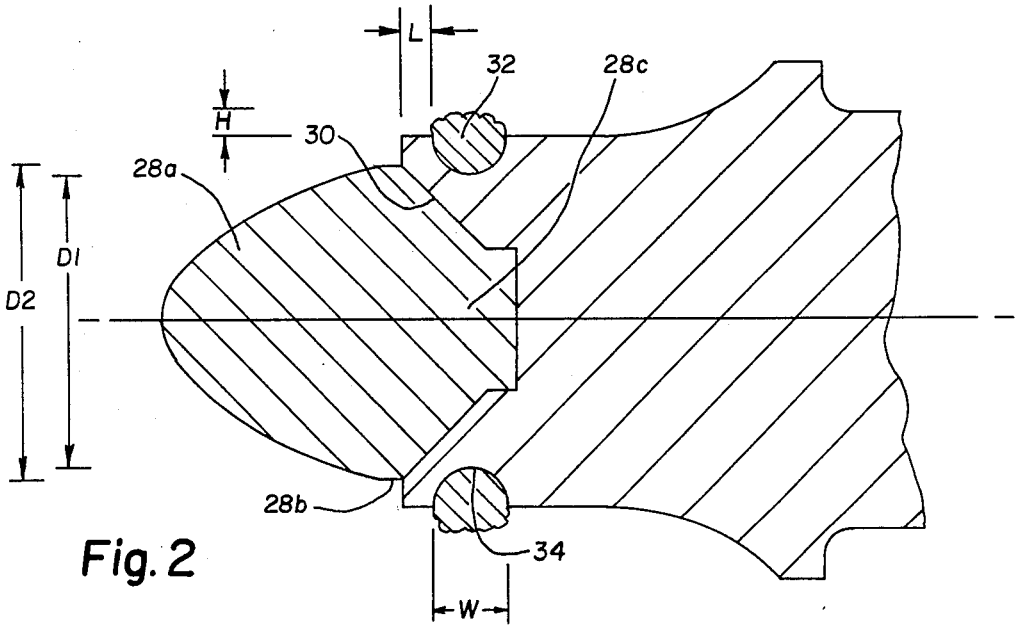
FIG. 2 is an exploded side elevational view of the cutting bit of FIG. 1 taken along section line 2—2.
Figure 3:
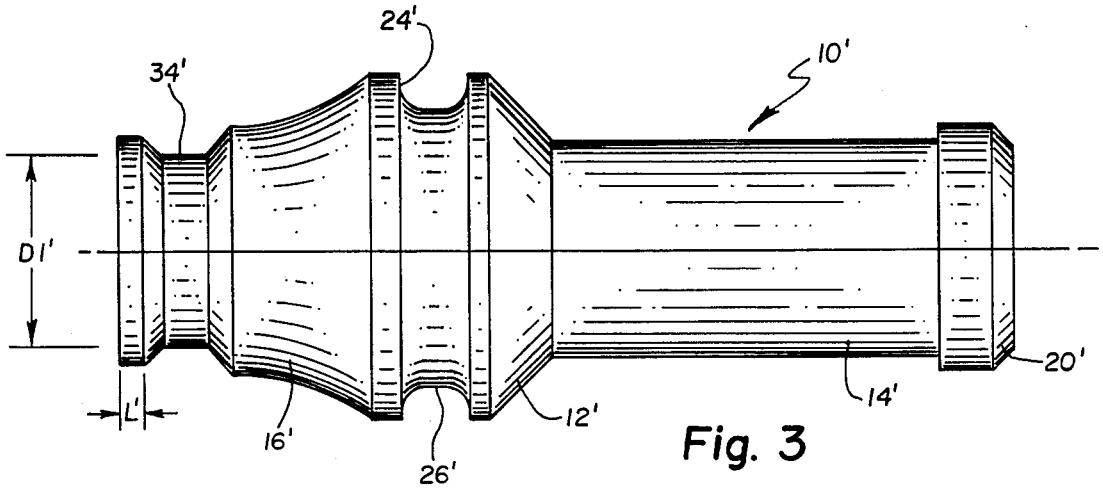
FIG. 3 is a side elevational view of another rotary cutting bit having an annular groove of a different cross-sectional configuration than that of the bit in FIG. 2, the body of the bit being shown without the hard tip and annular ring of hardfacing being present.

Referring now to the drawings, and particularly to FIGS. 1-3, there is shown a specific embodiment of a rotary cutting bit which can be mounted in a conventional manner on tools (not shown) intended for use in applications such as mining and excavating. The rotary cutting bit is generally designated as 10. The cutting bit 10 includes an elongated body 12 having a generally cylindrical, rearward shank portion 14 and a generally conical, forward head portion 16 which are constructed as a single piece.

A cylindrical retention sleeve 18, which is longitudinally slotted and made of resilient material, encompasses the shank portion 14 of the bit body 12 between rear and front annular flanges 20, 22 thereon. The retention sleeve 18 adapts the bit 10 for mounting in a socket (not shown) defined in a mounting block (not shown) attached to a rotatable member such as a wheel or drum (not shown). When the bit 10, with the retention sleeve 18 thereon, is mounted in the socket, its body 12 is contained within the socket from the rear end of the shank portion 14 up to the front annular flange 22 which generally separates the shank portion 14 from the conical head portion 16. Both the front annular flange 22 and a rear shoulder 24 on the head portion 16 (which is axially separated from the flange 22 by an annular recess 26) have diameters which are greater than that of the socket so as to preclude the possibility of the head portion being forced into the socket of the tool. The retention sleeve 18 tightly engages the socket and loosely engages the bit body shank portion 14, allowing the bit 10 to rotate during use.

The cutting tool 10 also includes a hard pointed insert or tip 28 attached on the forward end of the conical head portion 16 of the bit body 12. This hard tip 28 has a forward bullet-shaped portion **28*a*, a mediate cylindrical portion 28*b*, and a rearward valve seat portion 28*c* the diameter of the cylindrical portion 28*b* being D2. The hard tip is made of a wear resistant material such as cemented tungsten carbide, but may be made of any other wear resistant material suitable for the purpose. In contrast thereto, the conical body portion 16 and cylindrical shank portion 18 are made of a much less wear resistant, or softer, material than the hard tip 28, for instance carbon steel. In this regard, the cemented tungsten carbide may have a hardness of at least 86Ra ($69R_c$) and the steel body may have a hardness of between about $40R_c$–$45R_c$. Whereas the shank and head portions 14, 16 of the bit body 12 are constructed as a single piece, the tip 28 is constructed separate and then inserted and either cemented or brazed at the valve seat portion 28*c* into a generally concave tapered cavity 30** formed in the forward end of the head portion.

As explained earlier, because a softer (and much less expensive) material, such as carbon steel, is typically used in fabrication of the bit body 12, wash or erosion of the region of the head portion 16 backing the hard tip 28 is ordinarily experienced due to abrasive contact with the coal and rock formations being reduced by the tip. In the specific embodiment of the cutting bit 10, an erosion resistant structure in the form of an annular ring of hardfacing 32 is disposed about the bit body head portion 16 adjacent to and rearwardly of the hard tip 28 so as to provide a protective interface or an obstruction between most of the soft carbon steel composing the bit body 12 and the structure or formation being reduced. The hardfacing 32 is composed of erosion or wear resistant material which is much harder than carbon steel. For example, this hardfacing may be comprised of a hard metal such as a blend of tungsten carbide.

Additionally, as best seen in FIG. 2, the bit body head portion 16 has a groove 34 defined therein adjacent to and rearwardly of its forward end and the hard tip 28. The minimum diameter of the steel body at the annular groove portion is D1. The diameter D1 is smaller than the diameter D2 of the cylindrical portion of the hard insert 28. It can therefore be appreciated that a portion of the hardfacing is thus axially underneath of the hard tip. The annular ring of hardfacing 32 is deposited in the groove 34. The ring of hardfacing 32 fills the groove 34 and and is illustrated as projecting therefrom outwardly beyond an exterior surface 36 of the head portion 16. The groove 34 extends circumferentially about the head portion 14 and is illustrated as having a generally concave arcuate cross-sectional configuration, as seen in FIG. 2.

As illustrated in FIG. 3, the groove 34' can take on a different configuration than that illustrated in FIGS. 1 and 2. More particularly, the groove can take on a tapered or trapezoidal cross-sectional configuration as illustrated. The remaining portions of the bit body are the same as the embodiment illustrated in FIGS. 1 and 2 and are illustrated with the same reference numeral, but primed.

The hardfacing deposit is positioned around the steel body and is dimensioned relative to the hard insert so as to increase the life of the present bit over that of a bit that does not use the hardfacing. As previously mentioned, the minimum diameter D1 of the steel body at the annular groove is less than the diameter D2 of the cylindrical portion **28*b***. This results in a portion of the hardfacing being positioned underneath the hard carbide tip. As can be appreciated, during the cutting operation the hard insert impacts the material to be cut whereupon the cut material passes rearwardly towards the hardfacing and the steel body. The exposed part of the front end of the steel head portion of the steel body is eroded away by the abrasive action of the cut material. Because the hardfacing is positioned underneath the hard carbide tip, the hardfacing protects the steel underneath the tip from erosion and tip loss thereby prolonging the bit life. If the hardfacing was not positioned underneath the tip, the steel between the hardfacing and the tip would erode leading to tip loss.

As illustrated in FIGS. 2 and 3, the hardfacing is located a distance L (or L') rearwardly of the front end of the steel body. It is desirable to form the channel, which in turn positions the hardfacing, as close as possible to the front end of the body. However, the channel should not be formed so that there exists a thin wall of steel separating the channel and the valve seat whereby application of the hardfacing distorts the surface of the valve seat to such an extent that a satisfactory braze joint is difficult to achieve. This distance (L or L') may range between 0.020 inches to 0.100 inches and is preferably between 0.040 inches and 0.070 inches.

As illustrated in FIG. 2, the hardfacing 32 is of a width W. In order to provide effective protection from erosion for the steel body the hardfacing should have a width equal to W at least 0.25 inches. The maximum width W of the hardfacing should be equal to about 0.75 inches since it is typical that the steel body does not erode at any point rearwardly of the hardfacing when the hardfacing is 0.75 inches wide. The preferred width of the hardfacing is 0.50 inches.

As illustrated in FIG. 2, the hardfacing extends a distance H from the surface of the steel body. This distance H may vary between being flush with the surface to 0.075 inches.

The hardfacing deposit is positioned to cover a location on the steel body that is severly impacted by the material to be excavated. This material is abrasive and has in the past caused the steel to erode or wash at this location in earlier devices. However, the hardfacing is now positioned so as to prevent and/or reduce steel erosion whereby the tip is better maintained on the steel body and the tool life is extended.

The erosion resistant rotary cutting bit of the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

What is claimed is:

1. A cutting bit comprising:

an elongate body having a rearward shank portion and a forward head portion;

a wear resistant tip attached to a forward end of said head portion; and an annular ring of hardfacing attached about said head portion adjacent to and rearwardly of said tip attached thereon, a portion of said hardfacing being axially underneath said tip, said hardfacing being composed of a material harder than that of said head portion.

2. The cutting bit as recited in claim 1, further comprising a retention sleeve disposed about said shank portion of said body.

3. The cutting bit as recited in claim 1, wherein said head portion has a groove defined therein adjacent to and rearwardly of said forward end of said head portion, said annular ring of hardfacing being deposited in said groove.

4. The cutting bit as recited in claim 3, wherein said ring of hardfacing fills said groove and projects therefrom outwardly beyond an exterior surface of said head portion.

5. The cutting bit as recited in claim 4 wherein said ring of hardfacing projects outwardly beyond the exterior surface of said head portion located axially rearward of the groove.

6. The cutting bit as recited in claim 3, wherein said groove extends circumferentially about said head portion and has a concave arcuate cross-sectional configuration.

7. A cutting bit comprising:

an elongate body having a rearward shank portion and a forward head portion, said head portion has a groove defined therein adjacent to and rearwardly of a forward end of said head portion;

a wear resistant tip attached to said forward end of said head portion; and an annular ring of hardfacing being deposited in said groove so as to be attached about said head portion adjacent to and rearwardly of said tip attached thereon, a portion of said hardfacing being axially underneath said tip, said hardfacing being composed of a material harder than that of said head portion, said tip has a maximum diameter portion, and the minimum diameter of the body at the groove being less than the maximum diameter of the tip.

8. The cutting bit as recited in claim 7, further comprising a retention sleeve disposed about said shank portion of said body.

9. The cutting bit as recited in claim 7, wherein said ring of hardfacing fills said groove and projects therefrom outwardly beyond an exterior surface of said head portion.

10. The cutting bit as recited in claim 7, wherein said groove extends circumferentially about said head portion and has a concave arcuate cross-sectional configuration.

11. The cutting bit as recited in claim 7 wherein said elongate body is made of steel.

12. The cutting bit as recited in claim 7 wherein said wear resistant tip is made of cemented tungsten carbide.

* * * * *